US006501495B1

(12) United States Patent
Ichikawa et al.

(10) Patent No.: US 6,501,495 B1
(45) Date of Patent: Dec. 31, 2002

(54) HEAT ACTIVATING AND THERMOSENSITIVE RECORDING FOR THERMOSENSITIVE ADHESIVE LABEL

(75) Inventors: Akira Ichikawa, Shizuoka (JP); Masanaka Nagamoto, Shizuoka (JP); Hiroshi Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/557,033

(22) Filed: Apr. 21, 2000

(30) Foreign Application Priority Data

| | | |
|---|---|---|
| Apr. 22, 1929 | (JP) | 11-114693 |
| Jun. 11, 1999 | (JP) | 11-165572 |
| Jul. 21, 1999 | (JP) | 11-205576 |
| Jul. 21, 1999 | (JP) | 11-205577 |
| Oct. 7, 1999 | (JP) | 11-286276 |

(51) Int. Cl.[7] ..... B65C 9/25; B65C 9/24; B41J 2/32

(52) U.S. Cl. ..... 347/171

(58) Field of Search ..... 347/212, 171; 156/384, 387

(56) References Cited

U.S. PATENT DOCUMENTS

| | | | | |
|---|---|---|---|---|
| 3,873,394 | A | 3/1975 | Pearl et al. | |
| 4,777,079 | A | 10/1988 | Nagamoto et al. | |
| 5,053,267 | A | 10/1991 | Ide et al. | |
| 5,110,389 | A | 5/1992 | Hiyoshi et al. | |
| 5,248,543 | A | 9/1993 | Yamaguchi et al. | |
| 5,763,354 | A | 6/1998 | Nagamoto | |
| 5,846,358 | A | 12/1998 | Nagamoto et al. | |
| 5,912,204 | A | 6/1999 | Yamada et al. | |
| 6,031,553 | A | 2/2000 | Nagamoto et al. | |
| 6,172,698 | B1 * | 1/2001 | Iwata et al. | 347/71 |

FOREIGN PATENT DOCUMENTS

| | | | |
|---|---|---|---|
| EP | 788972 A1 | | 8/1997 |
| FR | 2754761 | | 4/1998 |
| FR | 2754762 | | 4/1998 |
| JP | 5737534 | | 3/1982 |
| JP | 5943979 | | 3/1984 |
| JP | 5946265 | | 3/1984 |
| JP | 6045132 | | 3/1985 |
| JP | 6054842 | | 3/1985 |
| JP | 63303387 | | 12/1988 |
| JP | 5-11573 | | 3/1993 |
| JP | 5127598 | | 5/1993 |
| JP | 6008977 | | 1/1994 |
| JP | 6263128 | | 9/1994 |
| JP | 7121108 | | 5/1995 |
| JP | 7164750 | | 6/1995 |
| JP | 7258613 | | 10/1995 |
| JP | 11-65451 | * | 3/1999 |
| JP | 11-79152 | * | 3/1999 |
| JP | 11079152 | | 3/1999 |
| JP | 11-157141 | * | 6/1999 |
| WO | WO9802309 | | 1/1998 |

* cited by examiner

*Primary Examiner*—Huan Tran
(74) *Attorney, Agent, or Firm*—Cooper & Dunham LLP

(57) ABSTRACT

There is provided an apparatus for heat-activating a thermosensitive adhesive label. The thermosensitive label includes a support and a thermosensitive adhesive agent layer provided thereon which is not adhesive at room temperature, but becomes adhesive with application of heat. The apparatus according to the present invention includes a heating medium and a platen roller arranged opposite to the heating medium. The thermosensitive adhesive label is transported between the heating medium and the platen roller in a direction where the thermosensitive adhesive agent layer is faced with the heating medium. When a friction coefficient between the thermosensitive adhesive agent layers is less than 2.0, a pressing force of the thermosensitive adhesive label between the heating medium and the platen roller is in a range of from 50 to 5,000 g/25 mm at room temperature.

14 Claims, 9 Drawing Sheets

HEAT ACTIVATING AND THERMOSENSITIVE RECORDING FOR THERMOSENSITIVE ADHESIVE LABEL

BACKGROUND OF THE INVENTION

1. Field of the Invention

The present invention relates to apparatus and method for heat-activating, and heat-activating and thermosensitive-recording a thermosensitive agent layer of a thermosensitive adhesive label.

The present invention also relates to the thermosensitive adhesive label comprising a support and a thermosensitive adhesive agent layer provided thereon, which is not adhesive at room temperature, but can be made adhesive with application of heat thereto.

2. Description of the Related Art

Recently, a recording label, in particular, a thermosensitive recording label has been used in a wide variety of fields, for example, in a system of point of sales (POS). In most of the above-mentioned conventional thermosensitive recording labels, a pressure-sensitive adhesive agent layer is generally provided on a back side of a thermosensitive recording layer, so that the label is stored in such a way that a liner (i.e., disposable backing sheet) is attached to the pressure-sensitive adhesive agent layer.

Such a thermosensitive recording label is useful, but it has some drawbacks. For example, the liner must be discarded after being released from the adhesive layer. Thus, consideration must be given to the problem of waste disposal from the ecological viewpoint. In addition, manufacturing cost is increased because of not only cost of the liner itself but also expenses involved by treatment of the liner.

To solve the above problems, there are proposed recording labels without a liner. For instance, as disclosed in Japanese Laid-Open Utility Model Application Nos. 59-439979 and 59-46265, and Japanese Laid-Open Patent Application No. 60-54842, it has been proposed to employ an adhesive layer comprising an adhesive agent in microcapsule form, and to provide a releasing agent layer on a surface of the recording label opposite to the recording surface. By the above, conventional proposals, however, a sufficient adhesion can not be obtained, and printing can not be carried out on the surface of the label when the releasing agent layer is provided thereon.

Japanese Laid-Open Paten Application No. 63-303387 and Japanese Utility Model Publication No. 5-11573 disclose another recording label comprising a thermosensitive adhesive agent layer with no liner being attached thereto.

When such a recording label comprising the thermosensitive adhesive agent layer is used, it is necessary to heat-activate the thermosensitive adhesive agent layer by application of heat so as to make the thermosensitive adhesive layer sufficiently adhesive. With respect to the above-mentioned heat activation treatment, the following methods are conventionally proposed: the application of hot air or infrared rays to the thermosensitive adhesive agent layer (Japanese Utility Model Publication No. 5-11573); use of an electrical heater or induction coil (Japanese Laid-Open Application No. 5-127598); the application of microwave to the thermosensitive adhesive agent layer (Japanese Laid-Open Patent Application No. 6-8977); the application of xenon flash to the thermosensitive adhesive agent layer (Japanese Laid-Open Patent Application No. 7-121108); and the application of halogen lamp to the thermosensitive adhesive agent layer (Japanese Laid-Open Patent Application No. 7-164750).

There has been also proposed a heat activating method of the thermosensitive adhesive agent layer by bringing the thermosensitive adhesion agent layer into contact with a heating medium. For example, the thermosensitive adhesive agent layer is brought into contact with a belt as heating medium. In this case, the belt is heated by a thermal heater (Japanese Laid-Open Patent Application No. 57-37534). A heat-application drum and a heat-application roll serving as the above-mentioned heating media are disclosed in Japanese Laid-Open Application Nos. 60-45132 and 6-263128, respectively.

On the other hand, those heat activating methods have the shortcomings as follows, so that those proposals have not yet put to practical use.

In a case where heat is applied to the thermosensitive adhesive agent layer by use of electronic heater or halogen lamp, it is difficult to apply heat to the thermosensitive adhesive agent layer efficiently so as to lessen a safety against induction into a overheated state, and to use thermal energy efficiently, thereby leading to energy cost problem. Taking safety and cost problems into consideration, it is thought that a heating portion is also covered. In such a case, this makes it impossible to manufacture a compact apparatus.

In a case where a heat application is carried out by bring the thermosensitive adhesive agent layer into contact with the heat means such as the heat application drum, the heat application roll and the heating medium such as the belt which is heated by a heating unit, the heating unit must stand by in a heated state in order to accomplish a fast heat activation. This may induces safety problems. Also, there may be occasions that the thermosensitive adhesive agent layer is transferred into the heating unit or the heating medium during heat activating operation. Due to the above transfer problem, there may be occasions that the recording label is would around the heating unit.

In addition, when the above recording label also comprises a thermosensitive coloring layer, it is required to prevent a coloring reaction in a background of the thermosensitive coloring layer during the heat activating operation, so that a heat-resistance of the thermosensitive coloring layer must be improved and thermal sensitivity of the above recording label is low.

It should be noted that Japanese Laid-Open Patent Application No. 7-258613 discloses a activating method in which the thermosensitive adhesive agent layer is activated by pressing a heating unit against a substrate side of the recording label. Prevention of transfer of the thermosensitive adhesive agent layer into the heat means and wind of the recording label around the heat means can be realized in this way. However, this method causes thermal energy of the heat means to be used inefficiently because the thermal energy is not used sufficiently for the heat activation of the thermosensitive adhesive agent layer. Moreover, this heat activation of the thermosensitive adhesive agent layer can not be carried out quickly, so that operation efficiency of heat-activating and subsequent sticking the thermosensitive adhesive agent layer can be lowered.

Japanese Laid-Open Patent Application No. 11-79152 discloses a heat activating method and an apparatus for use in the method, in which a thermosensitive adhesive agent layer of a thermosensitive adhesive label is heated by a heating unit comprising a resistive element provided on a ceramic substrate and a protective layer provided on a surface of the resistive element. In this case, there may be occasions that meander movement of the thermosensitive adhesive label occurs to generate transportation failure because of poor slidability of the thermosensitive adhesive agent layer. Additionally, adhesive strength of the thermosensitive adhesive label may be decreased due to transfer of the thermosensitive adhesive agent layer into the heating medium or the like.

SUMMARY OF THE INVENTION

Accordingly, it is a general object of the present invention to provide a heat activating apparatus, a heat activating and thermosensitive recording apparatus, and heat-activating and thermosensitive-recording method, and a thermosensitive adhesive label for use in such method, in which the disadvantages of the aforementioned prior art are eliminated.

A first object of the present invention is to provide a heat activating apparatus, and a heat activating and thermosensitive recording apparatus in which when heat activation is carried out by a heating medium comprising a thin film resistive element provided on a ceramic substrate and a protective layer covering a surface of the thin film resistive element, good transportability of a thermosensitive adhesive label during heat activating operation, good heat activation of a selected region thereof and also good adhesion thereof into a medium to be adhered can be accomplished.

A second object of the present invention is to provide a method for heat-activating and thermosensitive-recording a thermosensitive adhesive label used in the above-mentioned apparatus.

A third object of the present invention is to provided a thermosensitive adhesive label for use in the above-mentioned apparatus and method.

The first object of the present invention can be achieved by an apparatus for heat-activating a thermosensitive adhesion label comprising a support and a thermosensitive adhesive agent layer which is provided on the support and is not adhesive at room temperature, so as to make the thermosensitive adhesive agent layer adhesive with application of heat thereto, comprising: a heating medium having a thin film resistive element on a ceramic substrate and a protective layer covering a surface of the thin film resistive element; and a platen roller arranged opposite to the heating medium, the platen roller forming a heat-activating unit with the heating medium, wherein the thermosensitive adhesive label is transported between the heating medium and the platen roller in a direction where the thermosensitive adhesive agent layer is faced with the heating medium, and further wherein when a friction coefficient between the thermosensitive adhesive agent layers is less than 2.0, a pressing force of the thermosensitive adhesive label between the heating medium and the platen roller is in a range of from 50 to 5000 g/25 mm at room temperature, and when the friction coefficient between the thermosensitive adhesive agent layers is between 2.0 and 3.0, the pressing force of the thermosensitive adhesive label between the heating medium and the platen roller is in a range of from 50 to 2000 g/25 mm at room temperature.

According to the present invention, an apparatus is disclosed for heat-activating and thermosensitive-recording a thermosensitive adhesive label comprising a support, a thermosensitive adhesive agent layer which is provided on a first side of the support and is not adhesive at room temperature, and a thermosensitive coloring layer which is provided on a second side of the support opposite to said thermosensitive adhesive agent layer, comprising:

a heat-activating unit comprising:

a heating medium having a thin film resistive element on a ceramic substrate and a protective layer covering a surface of the thin film resistive element; and a platen roller arranged opposite to the heating medium, the thermosensitive adhesive label being transported between the heating medium and the platen roller in a direction where the thermosensitive adhesive agent layer is faced with the heating medium, so as to make the thermosensitive adhesive agent layer adhesive; and a thermosensitive-recording unit for recording the thermosensitive coloring layer, the thermosensitive-recording unit arranged in a front or a rear position of the heat-activating unit, so as to achieve a thermosensitive recording, wherein when a friction coefficient between the thermosensitive adhesive agent layers is less than 2.0, a pressing force of the thermosensitive adhesive label between the heating medium and the platen roller is in a range of from 50 to 5000 g/25 mm at room temperature, and when the friction coefficient between the thermosensitive adhesive agent layers is between 2.0 and 3.0, the pressing force of the thermosensitive adhesive label between the heating medium and the platen roller is in a range of from 50 to 2000 g/25 mm at room temperature, and further wherein the friction coefficient between the thermosensitive adhesive agent layers is equal to or more than 0.5 times the friction coefficient between the thermosensitive coloring layers.

The second object of the present invention can be achieved by a method for heat-activating a thermosensitive adhesive label comprising a support and a thermosensitive adhesive agent layer which is provided on the support and is not adhesive at room temperature, comprising the steps of:

transporting the thermosensitive adhesive label between a heating medium having a thin film resistive element on a ceramic substrate and a protective layer covering a surface of the thin film resistive element, and a platen roller arranged opposite to the heating medium in a direction where the thermosensitive adhesive agent layer being faced with the heating medium; and bringing the thermosensitive adhesive agent layer into contact with the heating medium so as to make the thermosensitive adhesive agent layer adhesive, wherein when a friction coefficient between the thermosensitive adhesive agent layers is less than 2.0, a pressing force of the thermosensitive adhesive label between the heating medium and the patent roller is in a range of from 50 to 5000 g/25 mm at room temperature, and when the friction coefficient between the thermosensitive adhesive agent layers is between 2.0 and 3.0, the pressing force of the thermosensitive adhesive label between the heating medium and the platen roller is in a range of from 50 to 2000 g/25 mm at room temperature.

The second object of the present invention can also be achieved by a method for heat-activating and thermosensitive-recording a thermosensitive adhesive label comprising a support, a thermosensitive adhesive agent layer provided on a first side of said support and a thermosensitive coloring layer provided on a second side of the support opposite to said thermosensitive adhesive agent layer, comprising the steps of:

transporting the thermosensitive adhesive label between a heating medium having a thin film resistive element provided on a ceramic substrate and a protective layer covering a surface of the thin film resistive element, and a platen roller arranged opposite to the heating medium, heat-activating the thermosensitive adhesive label so as to make the thermosensitive adhesive agent layer adhesive, and thermosensitive-recording the thermosensitive coloring layer in a front or rear position of the heat-activating step, wherein when a friction coefficient between the thermosensitive adhesive agent layers is less than 2.0, a pressing force of said thermosensitive adhesive label between the heating medium and the platen roller is in a range from 50 to 5000 g/25 mm at room temperature, and when the friction coefficient between the thermosensitive adhesive agent layers is between 2.0 and 3.0, the pressing force of the thermosensitive adhesive label between the heating medium and the platen roller is in a range of from 50 to 2000 g/25 mm at room temperature, and further wherein the friction coefficient between the thermosensitive adhesive agent layers is equal to or more than 0.5 times the friction coefficient between the thermosensitive coloring layers.

The third objection of the present invention can be achieved by a thermosensitive adhesive label for use in an apparatus for heat-activating said thermosensitive adhesive label comprising a support, and a thermosensitive adhesive agent layer provided thereon, the apparatus comprising:

a heating medium having a thin film resistive element on a ceramic substrate and a protective layer covering a surface of the thin film resistive element; and a platen roller arranged opposite to the heating medium, the platen roller forming a heat-activating unit with the heating medium, wherein the thermosensitive adhesive label is transported between the heating medium and the platen roller in a direction where the thermosensitive adhesive agent layer is faced with the heating medium, and further wherein when a friction coefficient between the thermosensitive adhesive agent layers is less than 2.0, a pressing force of the thermosensitive adhesive label between the heating medium and the platen roller is in a range of from 50 to 5000 g/25 mm at room temperature, and when the friction coefficient between the thermosensitive adhesive agent layer is between 2.0 and 3.0, the pressing force of the thermosensitive adhesive label between the heating medium and the platen roller is in a range of from 50 to 2000 g/25 mm at room temperature, comprising:

the thermosensitive adhesive agent layer which is provided on the support is not adhesive at room temperature but is made adhesive with application of heat thereto, and is comprised of at least a thermoplastic resin and a thermofusible substance which is solid at room temperature but is molten during application of heat so as to soften or melt said thermoplastic resin.

The third objection of the present invention can also be achieved by a thermosensitive adhesive label for use in an apparatus for heat-activating and thermosensitive-recording a thermosensitive adhesive label comprising a support, a thermosensitive adhesive agent layer and thermosensitive coloring layer, the apparatus comprising:

a heat-activating unit comprising:

a heating medium having a thin film resistive element on a ceramic substrate and a protective layer covering a surface of the thin film resistive element; and a platen roller arranged opposite to the heating medium, the thermosensitive adhesive label being transported between the heating medium and the platen roller in a direction where the thermosensitive adhesive agent layer is faced with the heating medium, so as to make the thermosensitive adhesive agent layer adhesive; and a thermosensitive-recording unit for recording the thermosensitive coloring layer, the thermosensitive-recording unit arranged in a front or a rear position of the heat-activating unit, so as to achieve a thermosensitive recording, wherein when a friction coefficient between the thermosensitive adhesive agent layers is less than 2.0, a pressing force of the thermosensitive adhesive label between the heating medium and the platen roller is in a range of from 50 to 5000 g/25 mm at room temperature, and when the friction coefficient between the thermosensitive adhesive agent layers is between 2.0 and 3.0, the pressing force of the thermosensitive adhesive label between the heating medium and the platen roller is in a range of from 50 to 2000 g/25 mm at room temperature, and further wherein the friction coefficient between the thermosensitive adhesive agent layers is equal to or more than 0.5 times the friction coefficient between the thermosensitive coloring layers, comprising the thermosensitive adhesive agent layer which is provided on a first side of the support is not adhesive at room temperature but is made adhesive with application of heat thereto, and is comprised of at least a thermoplastic resin and a thermofusible substance which is solid at room temperature but is molten during application of heat so as to soften or melt the thermoplastic resin; and the thermosensitive coloring layer provided on a second side of the support opposite to the thermosensitive adhesive agent layer.

According to the present invention, there is provided thermosensitive adhesive label for use in a method for heat-activating a thermosensitive adhesive label comprising a support and a thermosensitive adhesive agent layer provided on a first side of said support, the method comprising the steps of:

transporting the thermosensitive adhesive label between a heating medium having a thin film resistive element on a ceramic substrate and a protective layer covering a surface of the thin film resistive element, and a platen roller arranged opposite to the heating medium in a direction where the thermosensitive adhesive agent layer being faced with the heating medium; and bringing the thermosensitive adhesive agent layer into contact with the heating medium so as to make the thermosensitive adhesive agent layer adhesive, wherein when a friction coefficient between the thermosensitive adhesive agent layers is less than 2.0, a pressing force of the thermosensitive adhesive label between the heating medium and the platen roller is in a range of from 50 to 5000 g/25 mm at room temperature and when the friction coefficient between the thermosensitive adhesive agent layers is between 2.0 and 3.0, the pressing force of the thermosensitive adhesive label between the heating medium and the platen roller is in a range of from 50 to 2000 g/25 mm at room temperature, comprising:

the thermosensitive adhesive agent layer which is provided on the first side of the support is not adhesive at room temperature but is made adhesive with application of heat thereto, and is comprised of at least a thermoplastic resin and a thermofusible substance which is solid at room temperature but is molten during application of heat so as to soften or melt the thermoplastic resin.

In accordance with the present invention, there is also provided a thermosensitive adhesive label for use in a method for heat-activating and thermosensitive-recording a thermosensitive adhesive label comprising a support, a thermosensitive adhesive agent layer and a thermosensitive coloring layer, the method comprising the steps of:

transporting the thermosensitive adhesive label between a heating medium having a thin film resistive element provided on a ceramic substrate and a protective layer covering a surface of the thin film resistive element, and a platen roller arranged opposite to the heating medium, heat-activating the thermosensitive adhesive label so as to make the thermosensitive adhesive agent layer adhesive, and thermosensitive-recording the thermosensitive coloring layer in a front or rear position of the heat-activating step, wherein when a friction coefficient between the thermosensitive adhesive agent layers is less than 2.0, a pressing force of the thermosensitive adhesive label between the heating medium and the platen roller is in a range of from 50 to 5000 g/25 mm at room temperature, and when the friction coefficient between the thermosensitive adhesive agent layers is between 2.0 and 3.0, the pressing force of the thermosensitive adhesive label between the heating medium and the platen roller is in a range of from 50 to 2000 g/25 mm at room temperature, and further wherein the friction coefficient between the thermosensitive adhesive agent layers is equal to or more than 0.5 times the friction coefficient between the thermosensitive coloring layers, comprising the thermosensitive adhesive agent layer which is provided on a first side of the support is not adhesive at room temperature but is made adhesive with application of heat thereto, and is comprised of at least a thermoplastic resin and a thermofusible substance which is solid at room temperature but is molten during application of heat so as to soften or melt the thermoplastic resin; and the thermosensitive coloring layer provided on a second side of the support opposite to the thermosensitive adhesive agent layer.

An advantage of the present invention is the provision of an apparatus for heat-activating, and heat-activating and thermosensitive-recording a thermosensitive adhesive label, the apparatus having good transportability of the thermosensitive adhesive label without transportation failure, such as meander movement of the label or the like, during heat activating operation.

Another advantage of the present invention is that good activation of a selected region of the thermosensitive adhesive label can be accomplished, thereby making the thermosensitive adhesive label adhesive in a desired pattern.

Still another advantage of the present invention is that it is easy to heat-activate the thermosensitive adhesive label with prevention of transfer of the thermosensitive adhesive agent layer into the heating unit.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
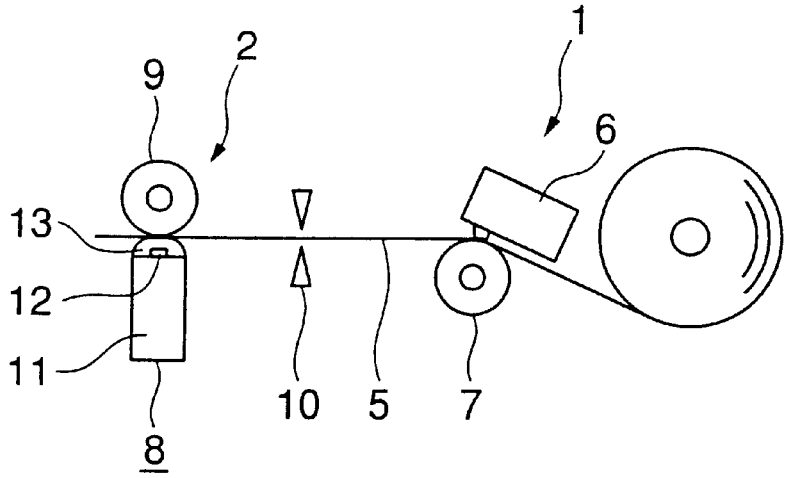
FIG. 1 is a schematic view which shows on embodiment of a printing apparatus (i.e., printer) according to the present invention.
Figure 2:
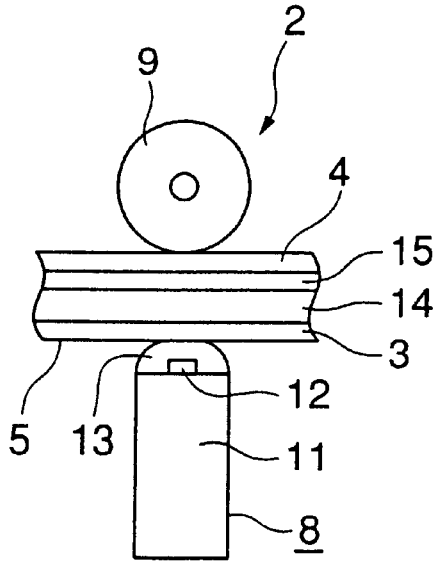
FIG. 2 is a cross-sectional view which shows enlarged detail of the heat-activating unit.

Referring to FIG. 1, there is shown a schematic view of a printer comprising a thermosensitive-recording unit 1 and a heat-activating unit 2. FIG. 2 illustrates a cross-sectional view which shows enlarged detail of the heat-activating unit 2. In this printer according to the present invention, a thermosensitive adhesive label is used, which comprises a thermosensitive adhesive agent layer 3 provided on one side of a support and a thermosensitive coloring layer 4 as a thermosensitive recording layer provide on the other side of the support opposite to the thermosensitive adhesive agent layer 3. The thermosensitive-recording unit 1 comprises a thermal head 6 and a platen roller 7 arranged opposite to the thermal head 6. The heat-activating unit 2 includes a thermal head 8 and a platen roller 9 arranged opposite to the thermal head 8. A cutter 10 is arranged between the thermosensitive-recording unit 1 and the heat-activating unit 2.

The thermal head 8 is formed with a ceramic substrate 11 and a thin film resistive element 12 provided thereon, a surface of the thin film resistive element 12 being covering with a protective layer 13. A structure of the thermal head 6 is substantially similar to that of the thermal head 8.

As shown in FIG. 2, the thermosensitive adhesive label 5 comprises the thermosensitive adhesive agent layer 3 provided on one side of the support 14 such as a wood-free paper, and a heat-insulating layer 15 is provided on the support 14 and the thermosensitive coloring layer 4 is provided on the other side of the support 14 opposite to the thermosensitive adhesive agent layer 3. When the thermosensitive adhesive label 5 is fed into the thermosensitive-recording unit 1, the thermosensitive coloring layer 4 is brought into contact with the thermal head 6. Conversely, when the thermosensitive adhesive label 5 is fed into the heat-activating unit 2, the thermosensitive adhesive agent layer 3 is brought into contact with the thermal head 8.

In the heat-activating unit 2, the thermosensitive adhesive label 5 is pressed between the thermal head 8 and the platen roller 9 with a given pressing force. When a friction coefficient between the thermosensitive adhesive agent layers 3 is less than 2.0, it is preferable that the above pressing force is in a range of from 50 to 5000 g/25 mm at room temperature (for example, 20° C.). When the friction coefficient between the thermosensitive adhesive agent layers 3 is between 2.0 and 3.0, it is preferable that the pressing force is in a range of from 50 to 2000 g/25 mm at room temperature.

Furthermore, in the thermosensitive-recording unit 1, the thermosensitive adhesive label 5 is also pressed between the thermal head 6 and the patent roller 7 with a certain pressing force. In order to obtain good printing quality, this pressing force is set to a higher value than that in the heat-activating unit 2. In addition, the friction coefficient between the thermosensitive coloring layers 4 is established to a lower value than that between the thermosensitive adhesive agent layers 3.

Measurement of the friction coefficient between the thermosensitive adhesive layers 3 was conducted as follows. The thermosensitive adhesive agent layer 3 is provide on the thermosensitive adhesive label 5 and this label 5 is then attached to a movable body to provide the layer 3 at a top side. After contacting the thermosensitive adhesive agent layers 3 together, measurement was performed by sliding the movable body. The friction coefficient between the thermosensitive coloring layers 4 was determined in the same way as described above.

Additionally, the pressing force of the thermosensitive adhesive label 5 between the thermal head 8 and the platen roller 9 was measured by pulling the thermosensitive adhesive label 5 pressed between the thermal head 8 and the platen roller 9 by use of spring balance. The pressing force of the thermosensitive adhesive label between the thermal head 6 and the platen roller 7 was measured in the same procedure.

Next, the following will be a description of the thermosensitive adhesive label 5. More specifically, a structure and materials of the label 5 will be explained in detail.

According to the present invention, the thermosensitive adhesive agent layer for use in the thermosensitive adhesive layer comprises:

(a) a thermoplastic resin which is not adhesive at room temperature but is made adhesive with application of heat thereto;

(b) a thermofusible substance which is a plasticizer, which assumes a solid state at room temperature (hereinafter referred to as a solid plasticizer) and is molten by the application of heat thereto so as to make the thermoplastic resin soft or melt, thereby finally generating adhesive thermoplastic resin; and (c) a tackifier for further strengthening the adhesiveness when necessary.

Examples of the thermoplastic resin used in the present invention include, but are not limited to, poly(vinyl acetate), poly(butyl methacrylate), synthetic rubber, vinyl acetate-2-ethylhexyl acrylate copolymer, vinyl acetate-ethylene copolymer, vinylpyrrolidone-styrene copolymer, styrene-butadiene copolymer, vinyl pyrrolidone-ethyl acetate copolymer, acryl-butadiene copolymer, styrene-acyl copolymer, and vinyl ether-vinylidene chloride copolymer or the like.

Examples of the solid plasticizer for use in the thermosensitive adhesive agent layer include, but are not limited to, diphenyl phthalete, dihexyl phthalate, dicyclohexyl phthalate, dihydroabiethyl phthalate, dimethyl isophthalate, sucrose benzoate, ethylene glycol dibenzoate, trimethylolethane tribenzoate, glyceride tribenzoate, pentaerythritol tetrabenzoate, sucrose octacetate, tricyclohexyl citrate and N-cyclohexyl-p-toluenesulfonamide or the like.

Examples of the tackifier used in the thermosensitive adhesive agent layer include, but are not limited to, rosin and derivatives thereof, for example, polymerized resin, hydrogenated rosin, esters of the above-mentioned rosin such as glycerin and pentaerythritol, and dimers of resin acid, terpene resin, petroleum resin, phenolic resin and xylene resin or the like.

In order to prevent deposition of scum on the thermal head, it is possible to use inorganic or organic filler in the thermosensitive adhesive agent layer. Examples of the filler include, but are not limited to, inorganic fillers such as calcium carbonate, silica, colloidal silica, zinc oxide, titanium oxide, aluminum hydroxide, zinc hydroxide, barium sulfate, clay, kaolin, talc, alumina, surface-treated calcium carbonate and silica or the like; and organic filler such as urea-formaldehyde resin, styrene-methacrylic acid copolymer, polystyrene resin and vinylidene chloride resin or the like.

Furthermore, the thermosensitive adhesive label may further comprise an undercoat layer or heat-insulating layer which is interposed between the support and the thermosensitive coloring layer and/or between the support and the thermosensitive adhesive agent layer. The heat-insulating layer used in the present invention is preferably a non-expandable heat-insulating layer which comprises fine void particles with a voidage of 30% or more, each comprising a thermoplastic resin for forming a shell. The non-expandable fine void particles for use in the heat-insulating layer, which are in an expanded state, contain air or other gases therein. It is preferable to use the fine void particles with an average particle size of 0.4 to 20 $\mu$m, more preferably 0.5 to 10 $\mu$m. The voidage of the fine particles for use in the heat-insulating layer is preferably 30% or more, and more preferably 50% or more.

It should be noted that the voidage of fine void particles means a ratio of an inner diameter to an outer diameter of the void particle, which is expressed by the following formula:

$$\text{Voidage} = \frac{\text{inner diameter of the void particle}}{\text{Outer diameter of the void particle}} \times 100$$

Examples of resins which are useful for the heat-insulating layer include latex such as styrene-butadiene rubber (SBR), methyl methacrylate-butadiene copolymer (MBR) and acrylonitrile-butadiene rubber (NBR); water-soluble resins such as polyvinyl alcohol, cellulose derivatives, starch and derivatives thereof, polyacrylic acid and derivatives thereof, styrene-acrylic acid copolymer and derivatives thereof, poly(meth)acrylylamide and derivatives thereof, styrene-acrylic acid-acrylamide terpolymer, amino modified polyvinyl alcohol, carboxy modified polyvinyl alcohol, epoxy modified polyvinyl alcohol, polyethylene imine, isobutylene-maleic acid anhydride copolymer and derivative thereof or the like.

According to the present invention, the fine void particles comprise a thermoplastic resin for forming a shell therefor. It is preferable to employ a copolymer resin comprising vinylidene chloride and acrylonitrile as the main component.

It should be noted that it is also possible to provide a seal layer (not shown) on the thermosensitive adhesive agent layer 3. A function of the seal layer is to prevent development of adhesive strength of the layer 3 due to temperature increase during storage of the thermosensitive adhesive label 5. For instance, coating liquid comprising water dispersion of silicone resin is coated on the layer 3 so as to form an extremely thin film of silicone resin thereon, thereby inducing no influence on adhesion increase of the layer 3 during heat activation.

The thermosensitive coloring layer comprises a coloring compound which can induce color formation by application of heat thereto. For instance, the above-mentioned coloring compound comprises a coloring agent such as a leuco dye and a color developer.

As the leuco dye for use in the present invention, which may be used alone or in combination, any conventional dyes used in the conventional leuco-dye-containing thermal recording materials can be utilized. For example, triphenylmethane leuco compounds, fluoran leuco compounds, phenothiazine leuco compounds, auramine leuco dye compounds, spiropyran leuco compounds and indolinophtalide compounds are preferably used.

As the color developer used in the thermosensitive coloring layer, there can be used a variety of electron-acceptor compounds and oxidizing agents which are capable of inducing color formation in the above-mentioned leuco dyes when coming in contact with leuco dyes under an action of heat thereto.

Turning now to FIG. 1, the thermosensitive adhesive label in the form of a roll is loaded into the printer according to the present invention. The label 5 is driven by rotating the platen roller 7, 9. The roll-like label 5 is transported by pulling the label 5 with the rotating platen roller 7, while the thermal head 6 presses against the platen roller 7. During this transportation step, the thermosensitive coloring layer 4 provided on the label 5 is printed by the thermal head 6 in a desired pattern. Then, the label 5 printed by the thermal head 6 is also transported, and passes through the cutter 10 and the label 5 is captured by both the thermal head 8 and the platen roller 9. After this capture, the label 5 is cut into a predetermined length by the cutter 10. The label 5 cut by this cutter 10 is fed by rotation of the platen roller 9 and at the same time the label 5 thus cut is heat by the thermal head 8, thereby giving rise to heat activation of the thermosensitive adhesive agent layer 3 of the label 5. In this way, at first, printing of the thermosensitive coloring layer 4 is accomplished and then, heat activation the thermosensitive adhesive agent layer 3 is carried out. The thermosensitive adhesive label 5 is cut into the predetermined length is ejected from the printer. A user receives the label thus prepared and this label is attached to a medium to be adhered, such as goods or the like.

Since the thermal head 8 always contacts with the thermosensitive adhesive agent layer, this contact allows heat to be transferred efficiently into the thermosensitive adhesive agent layer 3 so as to ensure that heat activation of the thermosensitive adhesive agent layer can be carried out reliably and safety. In addition, since a voltage can be applied to the thermal head 8 off and on, the thermal head 8 can be heated to a desired temperature simultaneously necessary for heat activation of the thermosensitive adhesive agent layer. Similarly, a temperature of the thermal head 8 can be decreased simultaneously into a temperature at which it is impossible to heat-activate the thermosensitive adhesive agent layer. In view of this, it is not necessary to keep the thermal head at a temperature where the thermosensitive adhesive agent layer can be heat-activated. This makes it possible to save energy cost for heat activation of the thermosensitive adhesive agent layer. Furthermore, there is no risk that the heat-activating apparatus and the thermosensitive adhesive label may be overheated from time to time, thereby enhancing safety of the operation.

Besides the above, since heat is transferred efficiently form the thermal head 8 to the thermosensitive adhesive agent layer, the thermosensitive adhesive label can be operated at a high rate, while contacting with the thermal head 8 so that heat activation of the thermosensitive adhesive agent layer can be carried out rapidly. This makes it possible to prevent the thermosensitive adhesive agent layer from transferring to the thermal head 8 and to improve the productivity of the printer.

Since the heat-insulating layer 15 is interposed between the support 14 such as the wood-free paper and the thermosensitive coloring layer 4, thermal energy for the thermosensitive adhesive agent layer, which is generated by the thermal head, can be efficiently utilized in the thermosensitive adhesive agent layer without escaping through the support into the thermosensitive coloring layer 4, so that color development of the thermosensitive coloring layer 4 can be prevented by the thermal energy for the thermosensitive adhesive agent layer 3. Similarly, this heat-insulating layer 15 is also interposed between the support 14 and the thermosensitive adhesive agent layer 3.

By provision of the heat-insulating layer between the support 14 and the thermosensitive coloring layer 4, the thermal energy applied by the thermal head 6 can be efficiently utilized, so that the sensitivity for the coloring reaction of the thermosensitive coloring layer can be improved. Due to the heat-insulating layer between the support 14 and the thermosensitive adhesive agent layer 3, the thyermosensitive adhesive agent layer 3 can be efficiently heat-activated. Therefore, it is possible to widen the difference between the heat-activation temperature of the thermosensitive adhesive agent layer 3 and the color development initiation temperature of the thermosensitive coloring layer 4.

Figure 3A:
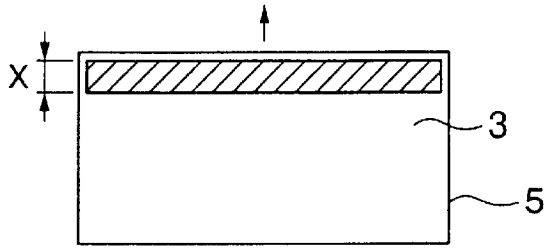
FIG. 3A through FIG. 3D illustrative various region of the thermosensitive adhesive agent layer with heat activation.
Figure 3B:
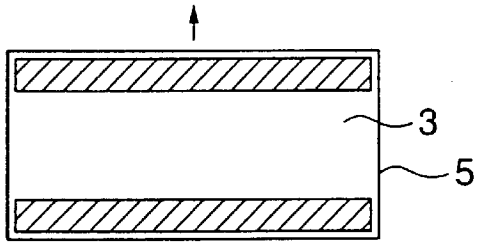

In the heat-activation unit 2 according to the present invention, besides the fact that the increase in the temperature necessary for the heat-activating operation can be carried out simultaneously in order to heat-activate the thermosensitive adhesive agent layer 3 and the decrease in the temperature can be performed simultaneously lest the thermosensitive adhesive agent layer 3 should be heat-activated as described above, the thermosensitive adhesive agent layer 3 can be heat-activated in a desired pattern by means of heat-controlling unit. To this end, a selected portion of the thermosensitive adhesive agent layer 3 can be heat-activated as shown in FIG. 3A to FIG. 3B. In FIG. 3 hatched portions of the thermosensitive adhesive agent layer 3 represent portions heat-activated by the thermal head 8. A transportation direction of the thermosensitive adhesive label 5 is shown by arrow in FIG. 3.

Figure 3C:
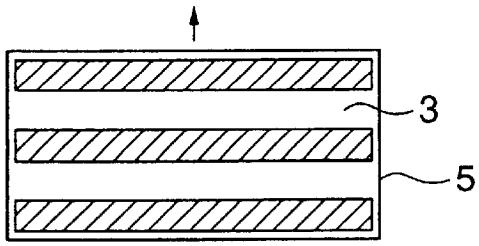
Figure 3D:
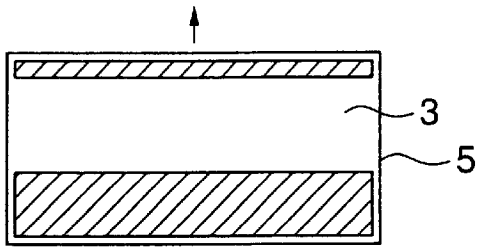

In FIG. 3A, a leading portion of the thermosensitive adhesive label 5 can be heat-activated in a direction perpendicular to the transportation direction shown by the arrow in the form of a stripe. A width x of the heat activation as shown in FIG. 3A is, for example, 8 mm. This thermosensitive adhesive label 5 is suited for use in a case where this label 5 is attached to goods like a bar. In FIG. 3B, the leading portion and a terminal portion of the thermosensitive adhesive label 5 can be heat-activated in the direction perpendicular to the transportation direction in the form two stripes. FIG. 3C illustrates the thermosensitive adhesive label 5 in which the leading portion and, the terminal portion and a middle portion of the thermosensitive adhesive agent layer 3 can be heat-activated in the direction perpendicular to the transportation direction in the form of three stripes. In FIG. 3D, the leading portion and the terminal portion of the thermosensitive adhesive agent layer 3 can be heat-activated in the direction perpendicular to the transportation direction in the form of two stripes, the latter portion having a different width from the former portion.

Figure 4A:
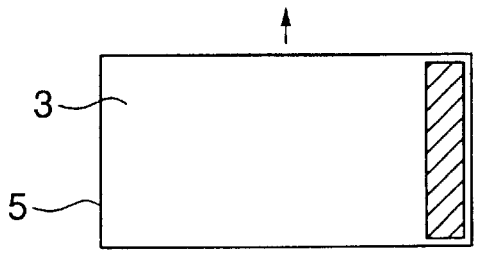
FIG. 4A through FIG. 4D illustrative various region of the thermosensitive adhesive agent layer with heat activation.
Figure 4B:
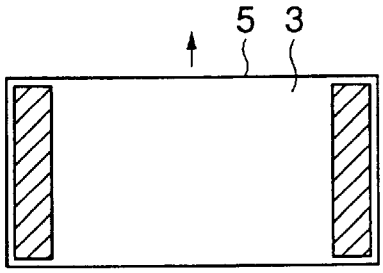
Figure 4C:
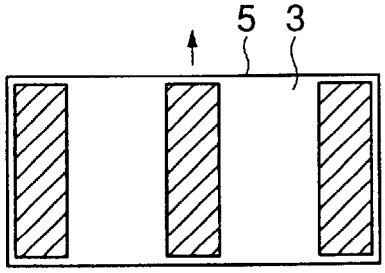
Figure 4D:
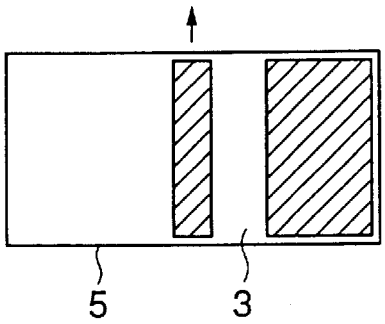

In FIG. 4A, one end portion of the thermosensitive adhesive layer 3 can be heat-activated in a direction parallel to the transportation direction as shown by arrow in this figure in the form of one stripe. FIG. 4B shows the thermosensitive adhesive label 5 in which both end portions of the thermosensitive adhesive agent layer 3 can be heat-activated in the direction similar to FIG. 4A. in the form of two stripes. As shown in FIG. 4C, both end portions and a center portion of the thermosensitive adhesive agent layer can be heat-activated in same direction as that of FIG. 4A. in the form of three stripes. In FIG. 4D, one end and the center portions of the thermosensitive adhesive agent layer 3 can be heat-activated in the direction parallel to the transportation direction in the form of two stripes, the former having a different width from the latter.

Figure 5A:
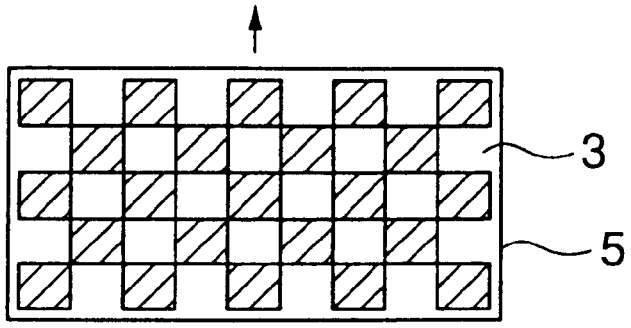
FIG. 5A through FIG. 5C illustrate various region of the thermosensitive adhesive agent layer with heat activation.
Figure 5B:
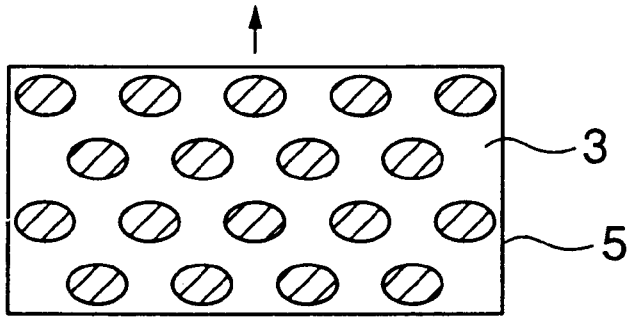
Figure 5C:
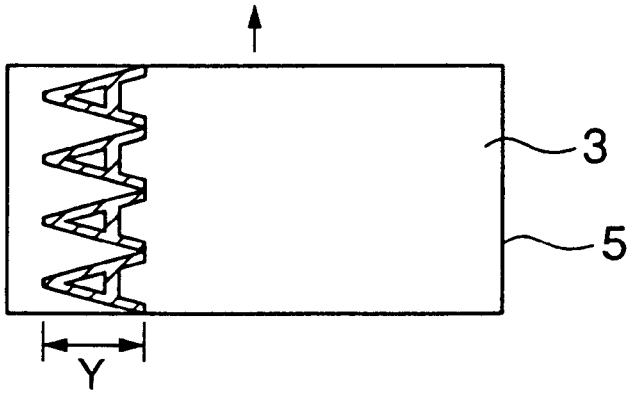

In FIG. 5A, the thermosensitive adhesive agent layer 3 of the thermosensitive adhesive label 5 can be heat-activated in a checkered pattern. This label 5 is suitable for easy-to-peel from goods. FIG. 5B illustrates the thermosensitive adhesive label 5 in which the thermosensitive adhesive agent layer 3 can be heat-activated in a polka-dot pattern, each dot having an ellipse form. In FIG. 5C, the thermosensitive adhesive agent layer 3 can be heat-activated in a continuous "A" character pattern as shown in this figure. In a "Y" portion of FIG. 5C, which is heat-activated, adhesion strength is increased from left to right.

Figure 6A:
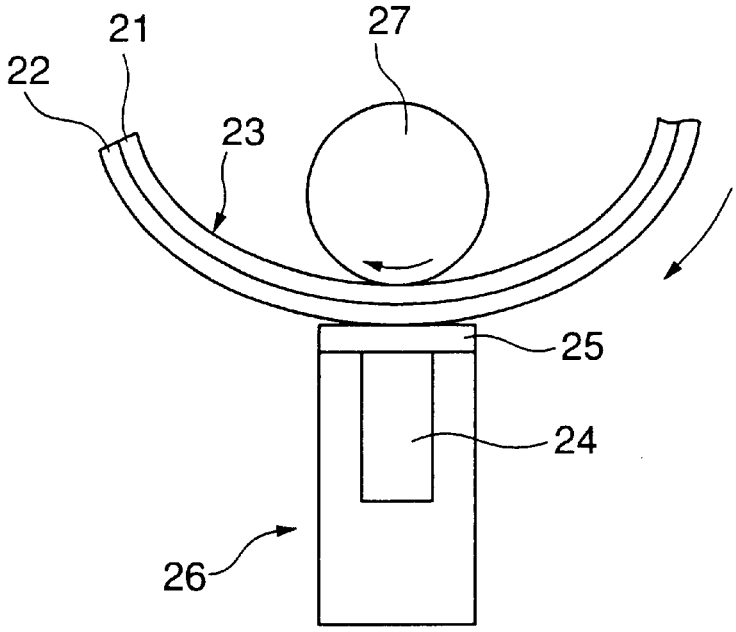
FIG. 6A and FIG. 6B show transportation states of the thermosensitive adhesive label in the heat activation unit according to the present invention.
Figure 6B:
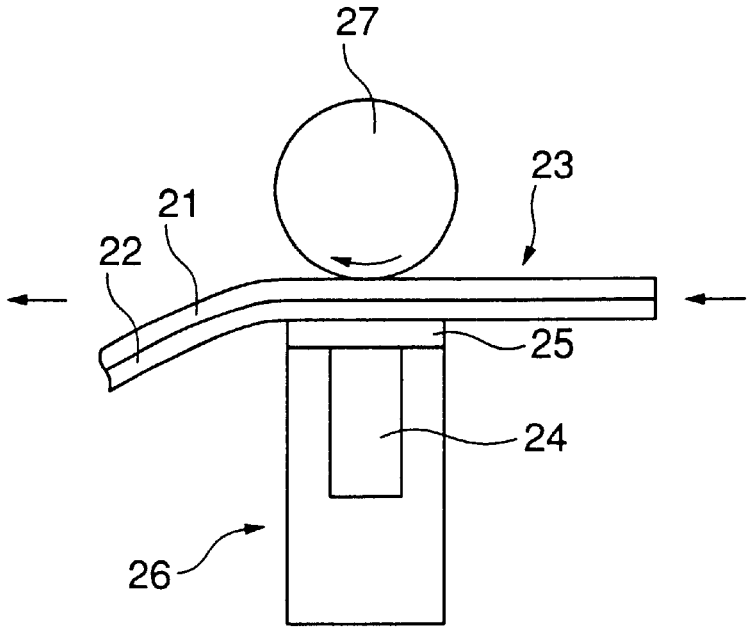

Referring to FIG. 6, there is shown another embodiment of a heat-activating unit according to the present invention. In this figure, a thermosensitive adhesive label 23 comprises a support 21 and a thermosensitive adhesive agent layer 22 including a thermoplastic resin, thermofusible substance and a tackifier. The heat-activating unit comprises a heating medium 26 having a thin film resistive element 24 on a ceramic substrate and a protective layer 25 provided on the element 24, and a roller 27 arranged opposite to the heating medium 26. Example of the heating medium 26 includes a thermal head as an efficient heating source. In the preferred embodiment of a heat-activating method according to the present invention, the thermosensitive adhesive label is transported in a direction indicated by an arrow of FIG. 6A. Right after heat activating operation, the label 23 is transported in a direction where the thermosensitive adhesive label 23 is separated from the heating medium 26. This makes it possible to prevent deposition of scum from the label 23. On the other hand, as shown in an arrow of FIG. 6B, when the label 23 is transported in a direction where the label 3 is moved downward while bringing into contact with the heating medium, there is arisen problems of scum deposition on the heating medium. The thermosensitive adhesive label 23 may be in the form of continuous member. In this case, the label may be cut into a predetermined length before or after heat-activating operation. As described previously, the support 21 and the thermosensitive adhesive agent layer 22 are conventionally known in this kind of thermosensitive recording materials.

Figure 7A:
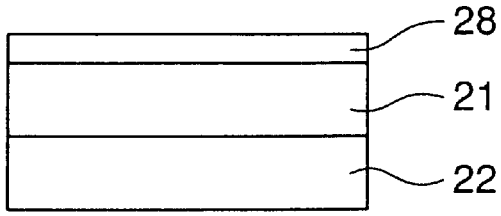
FIG. 7A and FIG. 7B are schematic views which show state of the thermosensitive adhesive label according to the present invention before heating and after heating, respectively.
Figure 7B:
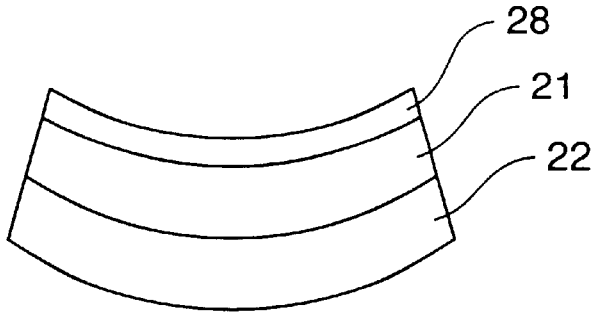

In FIG. 7A, there is shown the thermosensitive adhesive label 23 which is suitable for the heat-activating method in which the label 23 is transported in the direction where the thermosensitive adhesive label 23 is separated from the heat-activating unit right after heat-activating operation. A heat-shrinkable layer 28 is provided on the support 21 opposite to the thermosensitive adhesive agent layer 22, a heat-shrinking factor of the layer 28 being higher than that of the thermosensitive adhesive agent layer 22. As can be seen from FIG. 7B, therefore, shrink of the heat-shrinkable layer 28 allows the thermosensitive adhesive label 23 to be curled in the same direction as separating direction from the heating medium during heat-activating operation.

Examples of the heat-shrinkable layer used in the present invention include, but are not limited to, polyethylene, poly(vinyl chloride), polypropylene, poly(vinylidene chloride), polyester, polystyrene, ethylene-vinyl acetate copolymer, ionomer resin or the like. It is also possible to use biaxial oriented film or sheet of the above polymer. A thickness of the film or sheet is preferably from 5 to 400 $\mu$m, more preferably 30 to 200 $\mu$m. A shrinking factor in a longitudinal direction is preferable from about 3 to about 10%, the shrinking factor in a wide direction is preferably from about 3 to about 10%.

Figure 8:
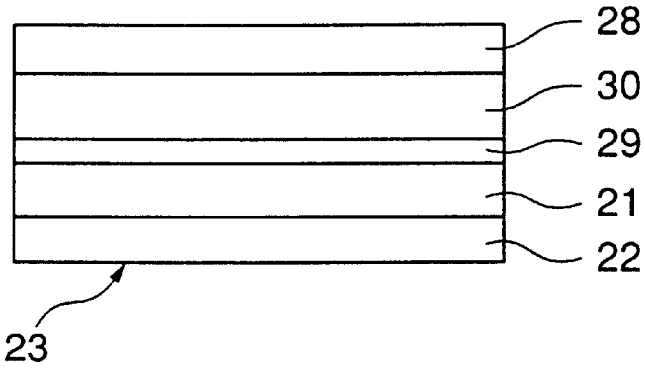
FIG. 8 shows a schematic cross-sectional view of the thermosensitive adhesive label according to the present invention.

There is shown a preferred embodiment of a thermosensitive adhesive label 23 according to the present invention, as shown in FIG. 8. The thermosensitive adhesive layer 23 comprises the support 21, such as the paper, the thermosensitive adhesive agent layer 22 on one side of the support 21, and a heat-insulating layer 29 and the thermosensitive coloring layer 30 comprising an electron-donating dye and an electron accepting compound provided on the other side of the support 21 opposite to the thermosensitive adhesive agent layer 22. The thermosensitive adhesive label may further comprise the heat-shrinkable layer 28 provided on the thermosensitive coloring layer 30. It should be noted that it is also possible to provide the thermosensitive coloring layer 30 on the heat-shrinkable layer 28.

Figure 9:
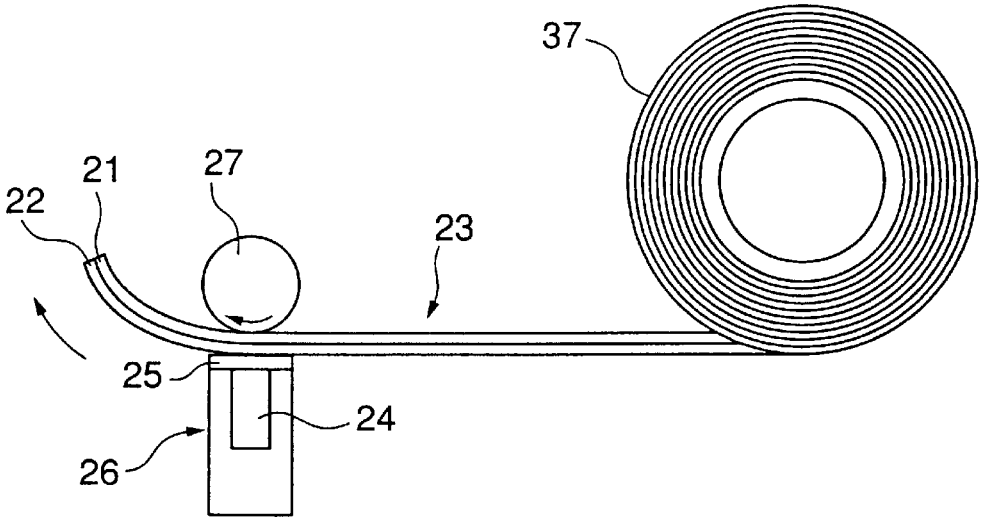
FIG. 9 is a vertical section which shows a transportation state of the thermosensitive adhesive label in the apparatus for heat-activating operation according to the present invention.

FIG. 9 illustrates a method for heat-activating the thermosensitive adhesive label 23 in such a way that the thermosensitive adhesive label 23 is separated from the heating medium 26 right after heat-activating operation. In this embodiment, the thermosensitive adhesive label 23 may be in the form of continuous member and the label 23 is wound to form a roll 37, thereby providing a curling property for the thermosensitive adhesive label 23. By loading such a thermosensitive adhesive label having the curling property which corresponds to the separating direction from the heating medium 26 prior to heat-activating operation, the thermosensitive adhesive label 23 can be easily separated from the heating medium 26 right after heat-activating operation.

Figure 10:
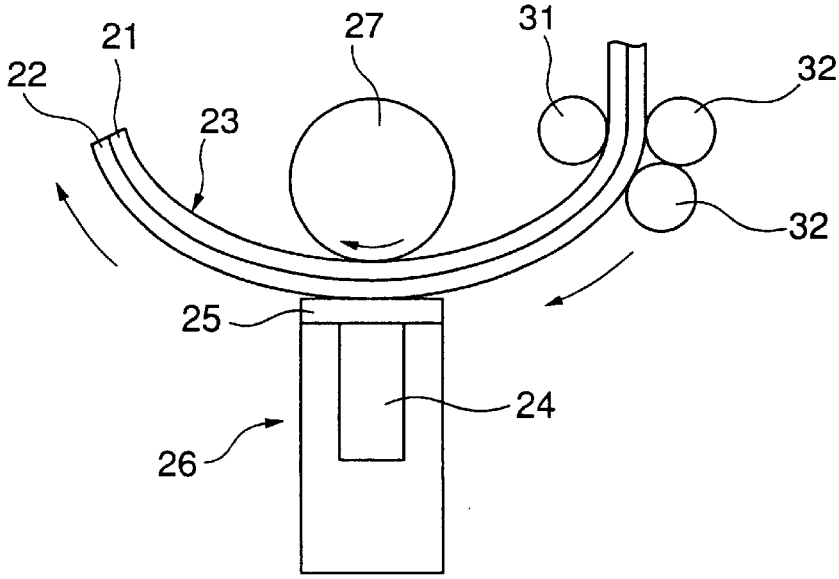
FIG. 10 is a vertical section which shows one embodiment of the heat activation unit according to the present invention.

FIG. 10 shows another embodiment of the heat-activating unit to perform separating function of the thermosensitive adhesive label from the heating medium right after heat-activating operation. A guide roller 31 is provided on the above the heating medium 26 in an upstream of feeding system. In this figure, at least one opposed roller 32 is arranged opposite to the guide roller 31 (this figure shows two rollers). The thermosensitive adhesive label is transported between the guide roller 31 and the opposed roller 32 while pressing the label 23. It is preferred that a hardness of the guide roller 31 which is brought into contact with the thermosensitive adhesive agent label 22 is higher than that of the opposed roller 32, so that curl formation of the thermosensitive adhesive label 23 can be accelerated during transportation. Examples of material for use in the guide roller and opposed roller include, but are not limited to, tetrafluoroethylene resin, acrylonitrile-butadiene rubber and silicone rubber or the like.

Figure 11:
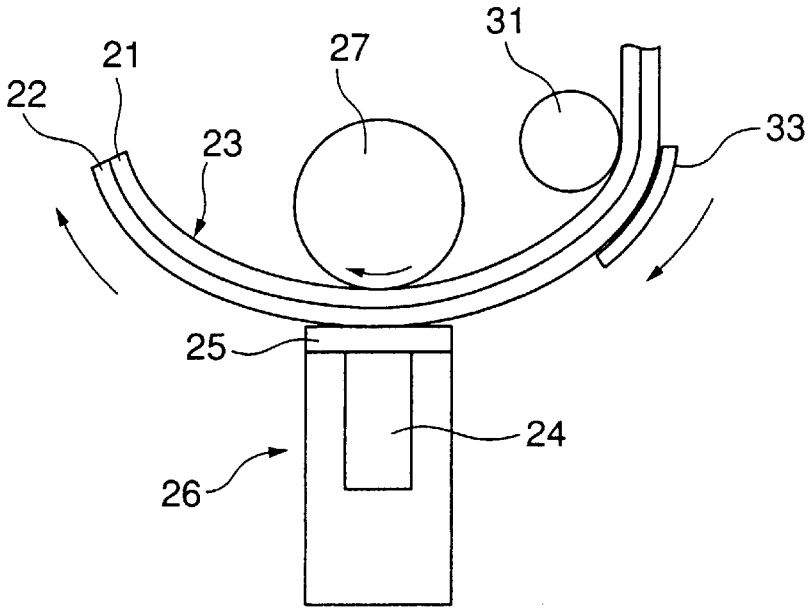
FIG. 11 is a vertical section which shows another embodiment of the heat activation unit according to the present invention.

Referring to FIG. 11, there is shown another embodiment of the heat-activating unit. There is provided a curve-faced guide member 33 in place of the opposed roller 32 of FIG. 10. In this case, it is also preferred that a hardness of the guide roller 31 which is brought into contact with the thermosensitive adhesive agent layer 22 is higher than that of the curve-faced guide member 33, so that curl formation of the thermosensitive adhesive label 23 can be promoted while passing between the guide roller 31 and the curve-faced guide member 33. Examples of material for use in the curve-faced guide member 33 include, but are not limited to, tetrafluoroethylene resin, acrylonitrile-butadiene rubber and silicone rubber or the like.

Figure 12:
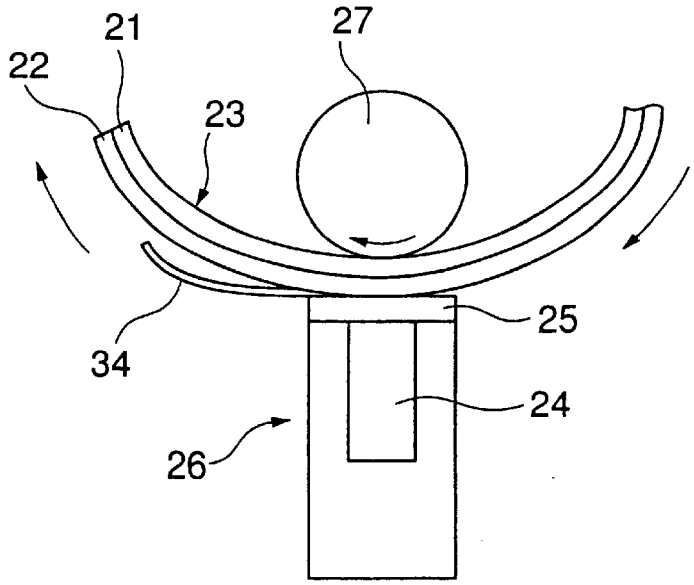
FIG. 12 is a vertical section which shows further another embodiment of the heat activation unit according to the present invention.

Referring to FIG. 12, disclosed is another embodiment of the heat-activating unit which further comprises a guide plate 34 provided in a downstream position. By use of the plate 34 of which surface has a releasability character, the thermosensitive adhesive layer 23 can be separated from the heating medium 26 right after heat-activating operation. In order to provide good releasability for the plate surface which is brought into contact with the thermosensitive adhesive agent layer 22 during transportation, it is preferred that the surface of the guide plate 34 is subjected to surface treatment by use of tetrafluoroethylene resin and silicone resin or the like.

Figure 13:
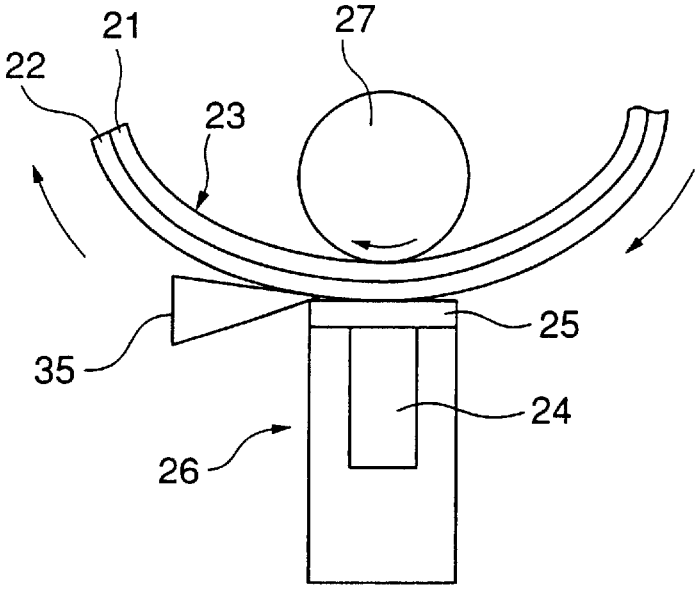
FIG. 13 is a vertical section which shows still further embodiment of the heat activation unit according to the present invention.

Referring to FIG. 13, there is shown another embodiment of the heat-activating unit which further comprises a separating wedge 35 to perform the same function as the guide plate 34 in FIG. 12. As is clear from the foregoing discussion, it is preferred that a surface of the separating wedge 35 is subjected to surface treatment by using tetrafluoroethylene resin and silicone resin or the like.

Figure 14:
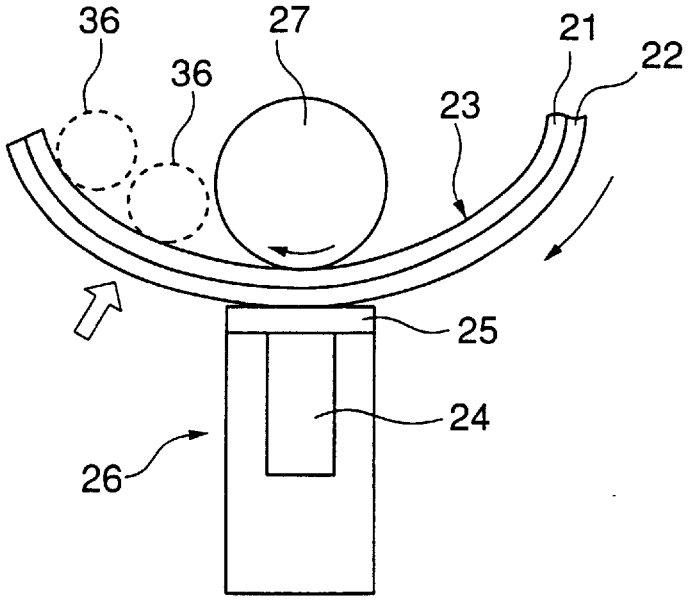
FIG. 14 is a vertical section which shows yet another embodiment of the heat activation unit according to the present invention.

FIG. 14 illustrates another embodiment of the heat-activating unit according to the present invention. There is provided at least one suction roll 36 arranged opposite to the thermosensitive adhesive agent layer 22 right after the heating medium 26. As can be seen from the FIG. 14, the thermosensitive adhesive layer can be separated from the heating medium 26 by an action of the suction roll 36. The suction roll 36 has a known suction ability. For instance, the suction roll 36 may be in the cylindrical form and a surface of the roll 36 has a plurality of pores, and inner pressure thereof is reduced. Also, it is possible to use a roll having an attractive force, such as an electrostatic force. In this case, it is also possible to utilize an air flow from the below the thermosensitive adhesive layer 23 as shown in a white arrow in the figure in order to assist in performing the function of the suction roll 36.

The present invention will be illustrated in greater detail with reference to examples given below, but are not to be construed as limiting the invention. In all examples, "parts" and "%" are based on weight unless otherwise stated.

EXAMPLES 1 TO 5

A mixture of the following components was separately pulverized and dispersed in a sand mill until an average particle size reached 2.0 $\mu$m or less, thereby obtaining Liquid A and Liquid B as given below.

| | parts by weight |
|---|---|
| Liquid A: dye dispersion | |
| 3-dibenzylamino-6-methyl-anilinofluoran | 20 |
| polyvinyl alcohol 10% aqueous solution | 20 |
| water | 60 |
| Liquid B: developer dispersion | |
| 4-hydroxy-4'-isopropoxydiphenylsulfone | 10 |
| polyvinyl alcohol 10% aqueous solution | 25 |
| calcium carbonate | 15 |
| water | 50 |

One part by weight of Liquid A and eight parts by weight of Liquid B were mixed and stirred, so that a thermosensitive coating Liquid C was prepared.

| Liquid D: coating liquid for non-expandable heat-insulating layer | parts by weight |
|---|---|
| aqueous dispersion of fine void particle (copolymer resin comprising vinylidene chloride and acrylonitrile as main component solid content: 32%, average particle diameter: 5 $\mu$m, and voidage: 92%) | 30 |
| styrene-butadiene copolymer latex (solid content: 47.5%) | 5 |
| water | 65 |

Liquid D was mixed and stirred, so that non-expandable heat-insulating layer coating liquid was prepare. This coating liquid comprising Liquid D was coated on a surface of a wood-free paper and dried in such a way that the deposition amount of this coating liquid was 5 g/m$^2$ on a dry basis. Thus, non-expandable heat-insulating layer was formed on the paper.

After the heat-insulating layer was formed on the paper, the thermosensitive coloring layer containing Liquid C was coated on the heat-insulating layer and dried in such a fashion that the deposition amount of the coating liquid was 5 g/m$^2$ on a dry basis. Then, a surface of the thermosensitive coloring layer thus prepared was subjected to a supercalendaring treatment so as to have a smoothness of from 600 to 700 sec in terms of Bekk's smoothness, thereby forming the thermosensitive coloring layer.

After formation of the heat-insulating layer and the thermosensitive coloring layer on a front surface of the paper, coating liquid comprising 40% water dispersion of dicyclohexyl phthalate, 50% water dispersion of styrene/natural rubber graft copolymer and 50% water dispersion of rosin ester (m.p.=120° C.) in a predetermined ratio as shown in Table 1 (see below) was coated on a back surface of the paper in such a way that the thermosensitive adhesive agent layer was provided on the back surface of the paper with a desired smoothness. Similar experiments for comparative examples 1 to 4 were conducted except using different coating liquids for the thermosensitive adhesive agent layer as shown in Table 1.

TABLE 1

Results of EXAMPLEs 1 to 5 and COMPARATIVE EXAMPLEs 1 to 4

| | Dicyclohexyl Phthalate Particle part diameter (μm) | | Styrene/natural rubber copolymer Styrene part Ratio | | Rosin ester Part | Dry Weight (g/m²) | Seal Layer Silicone Resin | Thermo-sensitive coloring layer 5 g/m² | Friction Coefficient 1 | 2 | 3 | 4 | Pressing force 5) (g/25 mm) | Trans-portation result 6 | 7 |
|---|---|---|---|---|---|---|---|---|---|---|---|---|---|---|---|
| EXAMPLE 1 | 1.2 | 100 | 25 | 100 | 25 | 18 | None | Provided | — | 1.90 | 0.70 | 2.71 | 1700 | ○ | ○ |
| EXAMPLE 2 | 3.5 | 100 | 70 | 100 | 50 | 12 | None | Provided | — | 0.75 | 0.70 | 1.07 | 4500 | ○ | ○ |
| EXAMPLE 3 | 1.2 | 100 | 25 | 100 | 25 | 18 | None | Provided | — | 1.90 | 0.70 | 2.71 | 4500 | ○ | ○ |
| EXAMPLE 4 | 1.2 | 100 | 0 | 150 | 25 | 25 | None | Provided | — | 2.80 | 0.70 | 4.00 | 1700 | ○ | ○ |
| EXAMPLE 5 | 3.5 | 100 | 70 | 100 | 50 | 12 | Provided | None | 0.3 | — | — | — | 4500 | ○ | — |
| COMPARATIVE EXAMPLE 1 | 1.2 | 100 | 75 | 100 | 25 | 18 | None | Provided | — | 1.90 | 0.70 | 2.71 | 5500 | Δ | ○ |
| COMPARATIVE EXAMPLE 2 | 1.2 | 100 | 0 | 150 | 25 | 25 | None | Provided | — | 2.80 | 0.70 | 4.00 | 4500 | x | ○ |
| COMPARATIVE EXAMPLE 3 | 1.0 | 100 | 0 | 150 | 20 | 30 | None | Provided | — | 3.20 | 0.70 | 4.57 | 1700 | Δ | ○ |
| COMPARATIVE EXAMPLE 4 | 3.5 | 100 | 70 | 100 | 50 | 12 | Provided | Provided | 0.3 | — | 0.70 | 0.43 | 5500 | Δ | Δ |

(Remarks)
1: Friction coefficient between the seal layers.
2: Friction coefficient between the thermosensitive adhesive agent layers.
3: Friction coefficient between the thermosensitive coloring layers.
4: Friction coefficient between the seal layer and the thermosensitive coloring layer or between the thermosensitive adhesive agent layer and the thermosensitive coloring layer.
5: This value during heat activation operation.
6: Result in the heat-activating unit 2.
(Estimate standard)
○: Good transportation (No occurrence of meander and termination of the thermosensitive adhesive label)
Δ: A slight transportation failure was observed.
x: Transportation failure occurs.
7: Result in the thermosensitive-recording unit 1.

As can be seen from the results shown in Table 1, when the friction coefficient of the thermosensitive adhesive agent layer is less than 2.0, the pressing force of the thermosensitive adhesive label between the thermal head and the platen roller is set to a value of 5000 g/25 mm or less, so that good transportation can be realized in the heat-activating unit according to the present invention. If the above pressing force is established to a value of 5000 g/25 mm or more during the heat activation operation, a slight transportation failure occurs in the thermosensitive adhesive label.

EXAMPLE 6

Preparation of a thermosensitive adhesive label in this example was substantially similar to EXAMPLE 1, except that a coating liquid of a thermosensitive adhesive agent layer was used in the following:

| | Parts by weight |
|---|---|
| 40% water dispersion of dicyclohexyl phthalate | 100 |
| 50% water dispersion of styrene/natural rubber graft copolymer | 100 |
| 50% water dispersion of rosin ester (m.p. = 120° C.) | 50 |

After formation of the heat-insulating layer of Liquid D and the thermosensitive coloring layer of Liquid C on a front surface of the paper, the above coating liquid for the thermosensitive adhesive agent layer was coated on a back surface of the paper in a such way that the deposition amount of the coating liquid was 25 g/m² on a dry basis.

The energy for heat activation applied to the thermosensitive adhesive agent layer was changed into 0.18, 0.23 and 0.36 mj/dot and region thus heated of the thermosensitive adhesive agent layer was also varied in the following pattern; all surfaces, three stripes (FIG. 3C) and checkered pattern (FIG. 5A).

EXAMPLE 6 was evaluated with respect to the following aspects:

(1) Adhesiveness of the thermosensitve adhesive agent layer by heat activation

A sample (40 mm×200 mm) was prepared from the thermosensitive adhesive agent layer of the thermosensitive adhesive label. The sample was heat-activated with varying the thermal energy. The thus heat-activated thermosensitive adhesive agent layer was attached to a polyvinyl chloride (PVC) wrap fixed on a stainless plate with aid of an adhesive tape. Load of 2 kg was applied onto the above thermosensitive adhesive agent layer with a to-and-fro motion. After 2 minutes, an unheated thermosensitive adhesive agent layer was peeled from the PVC wrap at an angle of 180 degree to evaluate adhesiveness. In this manner, the adhesivness of the thermosensitive adhesive agent layer to the PVC wrap was estimated on the following scale:

A; strong adhesiveness
B; medium adhesiveness
C; weak adhesiveness.

(2) Background density of the thermosensitive coloring layer in the course of heat activation of the thermosensitive adhesive agent layer.

The background density of the thermosensitive coloring layer was measured by means of McBeth densiometer RD-914 when the thermosensitive adhesive agent layer was thermally activated by the thermal head with energy as mentioned above. The background density of the thermosensitive coloring layer was 0.08 when the thermosensitive adhesive agent layer was not heat-activated.

(3) Transfer of the thermosensitive adhesive agent layer to heating medium.

The deposition of the thermosensitive adhesive agent layer onto a surface portion of the heating medium was visually inspected after a sample was subjected to heat activation. The transfer of the thermosensitive adhesive agent layer to the heating medium was evaluated on the following scale:

◎: No adhesive was observed on the surface portion of the heating medium by visual inspection.

○: A slight amount of adhesive was observed on another portion different from the surface portion of the heating medium by visual inspection.

Δ: A slight amount of adhexive was observed on the surface portion of the heating medium by visual inspection.

X: Many adhesives were observed on the surface of the heating medium by visual inspection (4) Initiation energy for coloring reaction of the thermosensitive coloring layer.

The thermosensitive adhesive label was loaded into the printer equipped with a commercially available thin film thermal head (manufactured by Matsushita Electronic Components Co., Ltd.). Printing was carried out on the thermosensitive coloring layer under conditions that the applied electric energy was 0.45 W/dot, the period for one line was 5 msec/line (line speed 25 mm/sec) and the scanning density was 8×7.7 dot/mm, with a pulse width changed between 0.4 msec and 0.5 msec. The coloring density of the thermosensitive coloring layer thus printed was measured by means of McBeth densiometer RD-914. When coloring density thereof was 1.0, the applied energy was determined as coloring initiation energy which is expressed by the following formula:

coloring initiation energy (*mj/dot*)=0.45 (w/dot)×a pulse width of density 1.0 (msec).

(5) Initiation energy for heat activation of the thermosensitive adhesive agent layer.

The same procedure as the above (4) was performed in this experiment. After heat activation with varying a pulse width, when the thermosensitive adhesive agent layer was beginning to make adhesive, the applied energy was defined as initiation energy for heat activation.

The results are summarized in Table 2.

TABLE 2

The results of EXAMPLE 6

| | Energy for HA[1)] (mj/dot) | Region of HA[1)] | Adhesiveness | Background density | Transfer of adhesive | Coloring initiation Energy (mj/dot) | Initiation energy for HA[1)] |
|---|---|---|---|---|---|---|---|
| EXAMPLE 6 | 0.18 | All | C | 0.08 | ○ | 0.29 | 0.14 |
| EXAMPLE 6 | 0.23 | All | B | 0.08 | ○ | — | — |
| EXAMPLE 6 | 0.36 | All | A | 0.08 | Δ | — | — |
| EXAMPLE 6 | 0.36 | Three stripes | B | 0.08 | ○ | 0.29 | 0.14 |
| EXAMPLE 6 | 0.36 | Checkered pattern | C | 0.08 | ◎ | 0.29 | 0.14 |

(Remark)
[1)]HA represents heat activation.

The results in Table 2 indicate that the thermosensitive adhesive label according to the present invention has good background density of the thermosensitive coloring layer thereof even in the event of heat activation of the thermosensitive adhesive agent layer. Furthermore, prevention of transfer of the thermosensitive adhesive agent layer to the surface of the heating medium can be accomplished in the thermosensitive adhesive layer according to the present invention although the heating medium is brought into contact with the thermosensitive adhesive layer.

EXAMPLE 7

A biaxial oriented heat-shrinkable polyethylene film having a 20 μm thicknesses was attached to the paper opposite to the thermosensitive adhesive agent layer formed by EXAMPLE 1 so as to obtain a sample of thermosensitive adhesive label as shown in FIG. 8. A surface of the thermosensitive adhesive agent layer of EXAMPLE 7 was subjected to a supercalendaring treatment so as to have a smoothness of 350 sec when measured by a method of Ohken-shiki prescribed in Japan Tappi No. 5.

COMPARATIVE EXAMPLE 5

The following components were stirred and dispersed, so that a coating liquid for a non-expandable heat-insulating layer was prepared.

| Liquid E: coating liquid for non-expandable heat-insulating layer | parts by weight |
|---|---|
| aqueous dispersion of fine void particle (copolymer resin comprising vinylidene chloride and acrylonitrile as main component solid content: 32%, average particle diameter: 5 μm, and voidage: 90%) | 30 |
| styrene-butadiene copolymer latex (Solid content: 50%) | 10 |
| water | 65 |

The thus prepared insulating layer coating liquid was coated on a wood-free paper and dried in such a manner that deposition amount of the coating liquid was 5 g/m$^2$ on a dry basis.

A mixture of the following components was pulverized and dispersed in a sand mill until the average particle size reached 2.0 μm or less.

| Liquid F: developer dispersion | parts by weight |
|---|---|
| 4,4'-dihydroxybenzophenone | 10 |
| polyvinyl alcohol (10% aqueous solution) | 25 |
| calcium carbonate | 15 |
| water | 50 |

One part by weight of Liquid A as described above and eight parts by weight of Liquid F were mixed and stirred, so that a coating liquid G was prepared.

The coating liquid was coated on the above obtained heat-insulating layer and dried in such a way that deposition amount of the coating liquid G was 5 g/m2 on a dry basis so as to form the thermosensitive coloring layer on the heat-insulating layer. Then, a surface of the coated layer was subjected to the supercalendaring treatment so as to have a surface smoothness of 1,000 sec in accordance with the method of Ohken-shiki prescribed in Japan Tappi No. 5.

A mixture of the following components was pulverized and dispersed in the sand mill until the average particle size reached 3.0 μm, thereby obtaining a coating liquid of the thermofusible dispersion (Liquid H).

| Liquid H: thermofusibel substance dispersion | Parts by weight |
|---|---|
| Dicyclohexyl phthalate | 40 |
| Dispersing agent based on amine | 8 |
| Water | 52 |

Then, a mixture of the following components and the liquid H were mixed to prepare a coating liquid of the thermosensitive adhesive agent layer.

| Liquid I: dispersion of the thermosensitive adhesive agent layer. | Parts by weight |
|---|---|
| MMA-butadiene latex (50%) | 30 |
| Terpene resin emulsion (m.p. = 120° C., 50%) | 20 |
| Liquid H | 50 |

On the back side of the paper, opposite to the side of the thermosensitive coloring layer with respect to the support, the above coating liquid was coated and dried in such a fashion that deposition amount of the above coating liquid was 15 g/m$^2$ on a dry basis. Then, a surface of the coated layer was subjected to the supercalendaring treatment so as to have a surface smoothness of 1,000 sec in accordance with the method of Ohken-shiki prescribed in Japan Tappi No. 5.

EXAMPLEs 6, 7 and comparative example 5 were evaluated with respect to the following aspects:

(6) Adhesive strength measured by peeling test at a peeling angle of 180 degree.

The thermal energy (0.45 mj/dot) of the thermal head (manufactured by Rohm Co., Ltd. KT2002-CA, head density: 8/mm) was applied to the thermosensitive adhesive agent layer of each sample. The thermosensitive adhesive agent layer thus heat-activated was attached to a stainless plate of SUS-304 with application of a load of 2 kg. After one minute, the thermosensitive adhesive agent layer was peeled from the SUS-304 plate at a peeling angle of 180 degree at a temperature of 20° C. by a method prescribed in JIS-Z-0237 to measure adhesive strength.

(7) Dynamic coloring density of the thermosensitive coloring layer.

Each thermosensitive adhesive label was loaded in the heat-activating apparatus equipped with a commercially available thin film thermal head (manufactured by Matsushita Electronic Components. Co., Ltd.). Printing was carried out on the thermosensitive coloring layer under the conditions that the applied electric power was 0.60 W/dot, the period for one line was 10 msec/line and scanning density was 8×7.7 dot/mm, with a pulse width having 0.4 msec and 0.5 msec. The coloring density of the thermosensitive coloring layer thus printed was measured by means of McBeth densitometer RD-914.

(8) Auto-sticking ability toward the polyvinyl chloride (PVC) wrap.

A sample (40 mm×60 mm) was prepared from the heat-activated thermosensitive adhesive agent layer of the thermosensitive adhesive label. Auto-sticking ability toward the PVC wrap of each sample was evaluated by means of a pneumatic auto-sticking printer (Manufactured by Teraoka Co., Ltd. HC-6200) on the following scale:

○: The sample was attached to the PVC wrap in a desired position.

Δ: The sample was attached to the PVC wrap out of position.

×: The sample was not attached to the PVC wrap.

(9) Over-heatability of the thermosensitive adhesive label.

The over-heatability of the label was examined by touching the paper support of the heat activated label with fingers. The over-heatability for each sample was evaluated on the following scale:

○: A temperature of the paper heat-activated by the thermal head was the same as room temperature.

Δ: The temperature of the paper heat-activated by the thermal head was higher than that of an atmosphere. (approximately 20 to 30° C. higher than the room temperature)

Δ: The temperature of the paper heat-activated by the thermal head was much higher than that of an atmosphere. (approximately 30° C. or more higher than the room temperature)

The results are tabulated in Table 3.

TABLE 3

Results of EXAMPLEs 6 and 7

| | Adhesive strength | Dynamic coloring density | | Auto-sticking | Over heat-ability | Smoothness |
|---|---|---|---|---|---|---|
| | (g/25 mm) | 0.4 ms | 0.5 ms | ability | ity | (sec) |
| EXAMPLE 6 | 1300 | 0.63 | 1.03 | ○ | ○ | 1000 |
| EXAMPLE 7 | 950 | 0.62 | 1.03 | ○ | ○ | 350 |
| COMPARATIVE EXAMPLE 5 | 250 | 0.62 | 1.04 | Δ | ○ | 1000 |

As can be seen from the results in Table 3, when the thermosensitive adhesive label according to the present invention is used, the label is excellent, safety and convenience from the viewpoint of workability. To be more specific, sufficient adhesion can be imparted to the thermosensitive adhesive agent layer by the method for heat-activating the label according to the present invention, so that the adhesive strength of the thermosensitive adhesive agent layer toward the surface to be adhered, such as polyvinyl chloride wrap, is satisfactory, and considered to be preferable in practical use.

In the following examples, residues on the heating medium were observed during heat-activation operation.

Each thermosensitive adhesive label was loaded into the various types of the heat-activating unit according to the present invention, which is equipped with a commercially available thin film thermal head (manufactured by Matsushita Electronic Components Co., Ltd.). Heat activation was carried out on the thermosensitive adhesive agent layer under the conditions that the applied electric power was 0.45 W/dot, the period for one line was 10 msec/line, and the scanning density was 8×7.7 dot/mm, with the pulse width of 1.0 msec and 0.45 mj/dot. All heating element of the heating medium were simultaneously heated so that an uniform heat was applied to the all width of the thermosensitive adhesive agent layer.

A width and a length of the thermosensitive adhesive agent layer were 40 mm and 2 m, respectively. All these area (40 mm×2 m) of the thermosensitive adhesive agent layer were heat-activated at a transporting rate of 80 mm/sec. After heat-activation operation, residues of the thermofusible substances accumulated of the heating medium were inspected visually. Evaluation of this experiment was based on the following scale:

A: No residue was observed on the heating medium.

B: Sign for residue was observed on the heating medium.

C: Residues were observed obviously on the heating medium.

D: Many residues were observed so as to give rise to transportation failure.

EXAMPLE 8

The thermosensitive adhesive label thus obtained in EXAMPLE 7 (hereinafter referred to label L-1) was thermally activated by the method shown in FIG. 6A.

EXAMPLE 9

The label L-1 was wound around a core having one inch diameter to form a roll-like label comprising the thermosensitive adhesive label thus prepared in EXAMPLE 7 (hereinafter referred to label L-2). This Label L-2 was heat-activated by the method described in FIG. 11.

EXAMPLE 10

The label L-2 was thermally activated by the method as explained in FIG. 10. In this case, the roller 31 has an outer diameter of 20 mm and is formed with a tetrafluoroethylene resin having a hardness of 50. The two opposed roller 32 was utilized, each having an outer diameter of 20 mm and forming with a tetrafluoroethylene resin having a hardness of 30.

EXAMPLE 11

The label L-2 was heat-activated by the method as shown in FIG. 11. In this method, the roller 31 has an outer diameter of 20 mm and is made with the tetrafluoroethylene resin having a hardness of 50. The curve-faced guide member 33 has an inner curvature radius of 10 mm and is made with the tetrafluoroethylene resin having a hardness of 30.

EXAMPLE 12

The label L-2 was thermally activated by the method illustrated in FIG. 12. In this case, the guide plate 34 has a plate size of 60 mm×80 mm. A surface of the plate 34 is subjected to surface treatment by use of the tetrafluoroethylene resin.

EXAMPLE 13

The label L-2 was heat-activated by the method as explained in FIG. 13. The separating wedge35 was subjected to surface treatment by the tetrafluoroethylene resin

EXAMPLE 14

The label L-2 was thermally activated by the method in FIG. 14.

EXAMPLE 15

The label L-1 which has not been wound, but was in the straight form, was heat-activated by the method shown in FIG. 10.

EXAMPLE 16

The label L-1 was thermally activated by the method as described in FIG. 13.

These results of the residue on the thermal heater were summarized in Table 4.

TABLE 4

The Results of EXAMPLEs 8 to 16

| | Heat-activation Unit | Evaluation of Residues |
|---|---|---|
| EXAMPLE 8 | FIG. 6A | A |
| EXAMPLE 9 | FIG. 11 | A |
| EXAMPLE 10 | FIG. 10 | A |
| EXAMPLE 11 | FIG. 11 | A |
| EXAMPLE 12 | FIG. 12 | A |
| EXAMPLE 13 | FIG. 13 | A |
| EXAMPLE 14 | FIG. 14 | A |
| EXAMPLE 15 | FIG. 10 | B |
| EXAMPLE 16 | FIG. 13 | B |

As can be seen from Table 4, by provision of separating unit right after the heating medium, the thermosensitive adhesive layer can be separated from the heating medium successfully without deposition of adhesive or the like thereon. These above unit according to the present invention allow the thermosensitive adhesive label to be transported smoothly, thereby generating no serious problems relating to transportation failure.

Additional modifications and variations of the present invention are possible in light of the above teachings. It is therefore to be understood that within the scope of the appended claims the invention may be practiced other than as specifically described herein.

The present application is based on Japanese priority application Nos. 11-114693 filed on Apr. 22, 1999, 11-165572 filed on Jun. 11, 1999, 11-205576 filed on Jul. 21, 1999, 11-205577 filed on Jul. 21, 1999 and 11-286276 filed on Oct. 7, 1999, the entire contents of which are hereby incorporation by references.

What is claimed is:

1. An apparatus for heat-activating a thermosensitive adhesive label comprising a support and a thermosensitive adhesive agent layer which is provided on said support and is not adhesive at room temperature, so as to make said thermosensitive adhesive agent layer adhesive with application of heat thereto, the thermosensitive adhesive agent layer having a friction coefficient which is determined by rubbing two thermosensitive adhesive agent layers against each other and measuring the friction coefficient, comprising:

a heating medium having a thin film resistive element on a ceramic substrate and a protective layer covering a surface of said thin film resistive element; and a platen roller arranged opposite to said heating medium, said platen roller forming a heat-activating unit with said heating medium, wherein said thermosensitive adhesive label is transported between said heating medium and said platen roller in a direction where said thermosensitive adhesive agent layer is faced with said heating medium, and further wherein when said friction coefficient between said thermosensitive adhesive agent layers is less than 2.0, a pressing force of said thermosensitive adhesive label between said heating medium and said platen roller is in a range of from 50 to 5000 g/25 mm at room temperature, and when said friction coefficient between said thermosensitive adhesive agent layers is between 2.0 and 3.0, said pressing force of said thermosensitive adhesive label between said heating medium and said platen roller is in a range of from 50 to 2000 g/25 mm at room temperature.

2. The apparatus as claimed in claim 1, further comprising a controlling unit for heating said heating medium in a predetermined pattern.

3. The apparatus as claimed in claim 1, further comprising a separating unit for separating said thermosensitive adhesive label from said heating medium right after heat activating operation.

4. The apparatus as claimed in claim 3, further comprising a guide roller provided on an upstream feeding system above said heat-activating unit.

5. The apparatus as claimed in claim 1, wherein said heating medium is a thin film heater or a thermal head.

6. An apparatus for heat-activating and thermosensitive-recording a thermosensitive adhesive label comprising a support, a thermosensitive adhesive agent layer which is provided on a first side of said support and is not adhesive at room temperature, and a thermosensitive coloring layer which is provided on a second side of said support opposite to said thermosensitive adhesive agent layer, the thermosensitive adhesive agent layer having a friction coefficient which is determined by rubbing two thermosensitive adhesive agent layers against each other and measuring the friction coefficient, the thermosensitive coloring layer having a friction coefficient which is determined by rubbing two thermosensitive coloring layers against each other and measuring the friction coefficient, comprising:

a heat-activating unit comprising:

a heating medium having a thin film resistive element on a ceramic substrate and a protective layer covering a surface of said thin film resistive element; and a platen roller arranged opposite to said heating medium, said thermosensitive adhesive label being transported between said heating medium and said platen roller in a direction where said thermosensitive adhesive agent layer is faced with said heating medium, so as to make said thermosensitive adhesive agent layer adhesive; and a thermosensitive-recording unit for recording said thermosensitive coloring layer, said thermosensitive-recording unit arranged in a front or a rear position of said heat-activating unit, so as to achieve a thermosensitive recording, wherein when said friction coefficient between said thermosensitive adhesive agent layers is less than 2.0, a pressing force of said thermosensitive adhesive label between said heating medium and said platen roller is in a range of from 50 to 5000 g/25 mm at room temperature, and when said friction coefficient between said thermosensitive adhesive agent layers is between 2.0 and 3.0, said pressing force of said thermosensitive adhesive label between said heating medium and said platen roller is in a range of from 50 to 2000 g/25 mm at room temperature, and further wherein said friction coefficient between said thermosensitive adhesive agent layers is equal to or more than 0.5 times said friction coefficient between said thermosensitive coloring layers.

7. The apparatus as claimed in claim 1, wherein said heating medium is a thin film heater or a thermal head.

8. An apparatus for heat-activating a thermosensitive adhesive label comprising a support and a thermosensitive adhesive agent layer which is provided on said support and is not adhesive at room temperature, so as to make said thermosensitive adhesive agent layer adhesive with application of heat thereto, comprising:

a heating medium having a thin film resistive element on a ceramic substrate and a protective layer covering a surface of said thin film resistive element; and a platen roller arranged opposite to said heating medium, said platen roller forming a heat-activating unit with said heating medium, wherein said thermosensitive adhesive label is transported between said heating medium and said platen roller in a direction where said thermosensitive adhesive agent layer is faced with said heating medium, and further wherein when a friction coefficient of said thermosensitive adhesive agent layer is less than 2.0, a pressing force of said thermosensitive adhesive label between said heating medium and said platen roller is in a range of from 50 to 5000 g/25 mm at room temperature, and when said friction coefficient of said thermosensitive adhesive agent layer is between 2.0 and 3.0, said pressing force of said thermosensitive adhesive label between said heating medium and said platen roller is in a range of from 50 to 2000 g/25 mm at room temperature.

9. The apparatus as claimed in claim 8, further comprising a controlling unit for heating said heating medium in a predetermined pattern.

10. The apparatus as claimed in claim 8, further comprising a separating unit for separating said thermosensitive adhesive label from said heating medium right after heat activating operation.

11. The apparatus as claimed in claim 10, further comprising a guide roller provided on an upstream feeding system above said heat-activating unit.

12. The apparatus as claimed in claim 8, wherein said heating medium is a thin film heater or a thermal head.

13. An apparatus for heat-activating and thermosensitive-recording a thermosensitive adhesive label comprising a support, a thermosensitive adhesive agent layer which is provided on a first side of said support and is not adhesive at room temperature, and a thermosensitive coloring layer which is provided on a second side of said support opposite to said thermosensitive adhesive agent layer, comprising:

a heat-activating unit comprising:

a heating medium having a thin film resistive element on a ceramic substrate and a protective layer covering a surface of said thin film resistive element; and a platen roller arranged opposite to said heating medium, said thermosensitive adhesive label being transported between said heating medium and said platen roller in a direction where said thermosensitive adhesive agent layer is faced with said heating medium, so as to make said thermosensitive adhesive agent layer adhesive; and a thermosensitive-recording unit for recording said thermosensitive coloring layer, said thermosensitive-recording unit arranged in a front or a rear position of said heat-activating unit, so as to achieve a thermosensitive recording, wherein when a friction coefficient of said thermosensitive adhesive agent layer is less than 2.0, a pressing force of said thermosensitive adhesive label between said heating medium and said platen roller is in a range of from 50 to 5000 g/25 mm at room temperature, and when said friction coefficient of said thermosensitive adhesive agent layer is between 2.0 and 3.0, said pressing force of said thermosensitive adhesive label between said heating medium and said platen roller is in a range of from 50 to 2000 g/25 mm at room temperature, and further wherein said friction coefficient of said thermosensitive adhesive agent layer is equal to or more than 0.5 times a friction coefficient of said thermosensitive coloring layer.

14. The apparatus as claimed in claim 13, wherein said heating medium is a thin film heater or a thermal head.

* * * * *

UNITED STATES PATENT AND TRADEMARK OFFICE

CERTIFICATE OF CORRECTION

PATENT NO. : 6,501,495 B1 
DATED : December 31, 2002
INVENTOR(S) : Akira Ichikawa, Masanaka Nagamoto and Hiroshi Yamada It is certified that error appears in the above-identified patent and that said Letters Patent is hereby corrected as shown below:

Title Page,
Item [30], Foreign Application Priority Data, please change "Apr. 22, 1929" to -- Apr. 22, 1999 --.

Signed and Sealed this

Eighth Day of June, 2004

JON W. DUDAS
*Acting Director of the United States Patent and Trademark Office*